US005353002A

United States Patent [19]

Jozefczyk

[11] Patent Number: 5,353,002

[45] Date of Patent: Oct. 4, 1994

[54] COIL BOBBIN AND SEALING COUPLER

[75] Inventor: John Jozefczyk, Dearborn, Mich.

[73] Assignee: Ford Motor Company, Dearborn, Mich.

[21] Appl. No.: 811,857

[22] Filed: Dec. 23, 1991

[51] Int. Cl.[5] ..... H01F 15/10

[52] U.S. Cl. ..... 336/192

[58] Field of Search ..... 336/192, 90, 98, 198, 336/208; 335/284; 361/38, 39, 41

[56] References Cited

U.S. PATENT DOCUMENTS

| | | | |
|---|---|---|---|
| 1,763,115 | 6/1930 | Wermine | 264/250 |
| 2,432,194 | 12/1947 | Hanchett | 336/90 |
| 2,447,631 | 8/1948 | Braithwaite | 336/192 |
| 3,928,831 | 12/1975 | Yatsushiro | 335/262 |
| 4,299,374 | 11/1981 | Yamanaka | 251/129.21 |
| 4,408,176 | 10/1983 | Nakamura | 336/107 |
| 4,918,419 | 4/1990 | Ida | 336/192 |
| 5,128,642 | 7/1992 | Anders et al. | 335/284 |
| 5,200,731 | 4/1993 | Tochio et al. | 336/98 |

*Primary Examiner*—Leo P. Picard
*Assistant Examiner*—Christopher Horgan
*Attorney, Agent, or Firm*—Richard D. Dixon; Roger L. May

[57] ABSTRACT

A bobbin assembly is provided for sealing with the end section of a coil of wire as it exits the housing of an automotive electrical component. The assembly includes a bobbin for receiving and carrying the coil of wire. A cap couples with the housing so as to restrain the coiled wire therein. The cap includes an aperture adapted to receive the end section of the wire therethrough. A bobbin tower distends from the bobbin and includes therein a slot for receiving, coupling and sealing with the end section of the wire, and for coupling with and sealing against the cap adjacent the aperture therein. The bobbin tower is compressed between the housing and the cap for compressing a crown section of the bobbin tower into the aperture in the cap. A method for using the bobbin assembly is also provided.

11 Claims, 2 Drawing Sheets

COIL BOBBIN AND SEALING COUPLER

BACKGROUND OF THE INVENTION

1. Field of the Invention

The present invention relates to coil bobbins and housings for automotive accessories such as cranking motor solenoids that employ self-sealing couplers for restraining and sealing with an end section of a wire communicating into a housing.

2. Prior Art and Problems Addressed

In automotive applications requiring the use of large electrical currents, such as cranking motors, cranking motor solenoids, alternators, etc., it is advisable to reduce the number of connections utilized in bringing the ends of coil wires to terminals or connectors located external to the housing. It is normally necessary to form an integral seal between the housing and the wire in order to prevent the contamination of components within the housing by water, dirt, or manufacturing materials such as solder.

While these objectives can be attained by the use of hand assembly and soldering techniques, these manufacturing methods are highly inefficient in high volume, high quality, low cost applications. Examples of solutions suitable for low volume manufacturing processes include Braithwaite in U.S. Pat. No. 2,447,631 which discloses the use of a thermoplastic, heat-softenable barrier material that is wrapped around a section of the wire as it exits the housing. Hanchett in U.S. Pat. No. 2,432,194 seals the opening through which the lead wires exit the housing by filling the holes with a suitable composition which is first melted and then poured into the opening so as to cool and solidify for forming a barrier against undesirable contaminates.

In order to address the obvious cost, reliability and manufacturing disadvantages of these and similar manufacturing methodologies, it is an object of the present invention to provide an apparatus and method for sealing an end section of a coil of wire as it communicates through and exits an aperture in the housing of an automotive accessory. It is a further object of the present invention to reduce the requirement for expensive hand assembly and to provide an assembly that lends itself to high volume, low cost automated manufacturing techniques.

SUMMARY OF THE INVENTION

Accordingly, the present invention utilizes a sealing member for coupling around the end section of a coil of wire as it exits an internal cavity of a housing. A device internal to the housing, such as a bobbin tower, is utilized for applying pressure to the sealing member so as to cause it to deform in both a longitudinal direction, as measured along the longitudinal axis of an end section of the wire, for sealing with the sections of the housing adjacent the aperture through which the wire exits, and also in a radial direction, with reference to the longitudinal axis of wire, for providing a seal therewith. In a first preferred embodiment the pressure is exerted on the sealing member by coupling it between the bobbin tower and a cap section of the housing.

BRIEF DESCRIPTION OF THE DRAWINGS

Other objects, features, and advantages of the present invention will become apparent from the careful study of the written description and drawings in which.

DESCRIPTION OF THE PRIOR ART

Figure 1A:
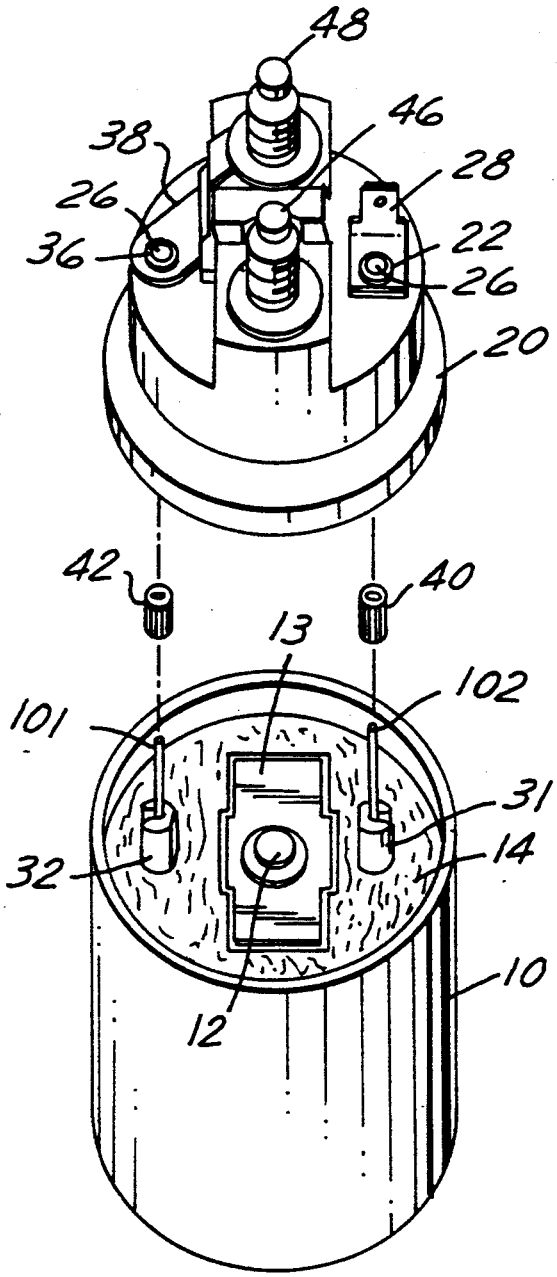
(PRIOR ART) FIG. 1A
FIG. 1A is a partially exploded frontal perspective view of a prior art cranking motor solenoid illustrating the use of tubular type deformable spacers.
Figure 1B:
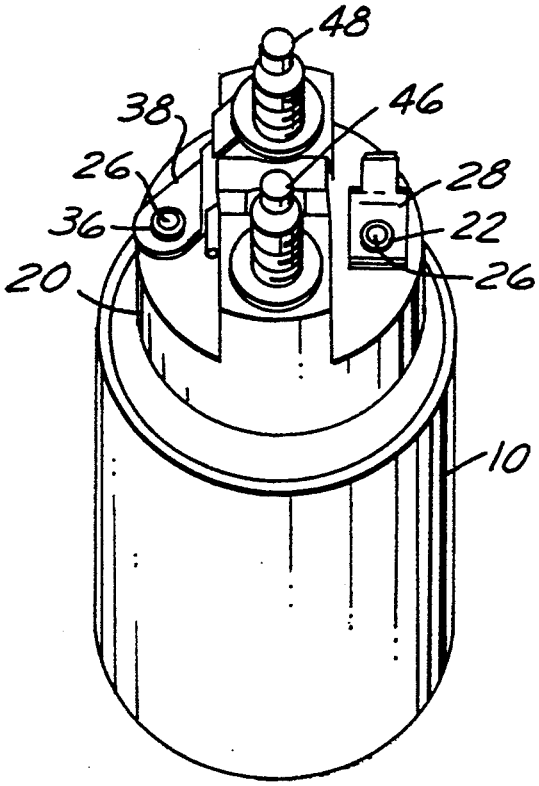
(PRIOR ART) FIG. 1B
FIG. 1B is a frontal perspective view of the fully assembled cranking motor solenoid shown in prior art FIG. 1A.
Figure 1C:
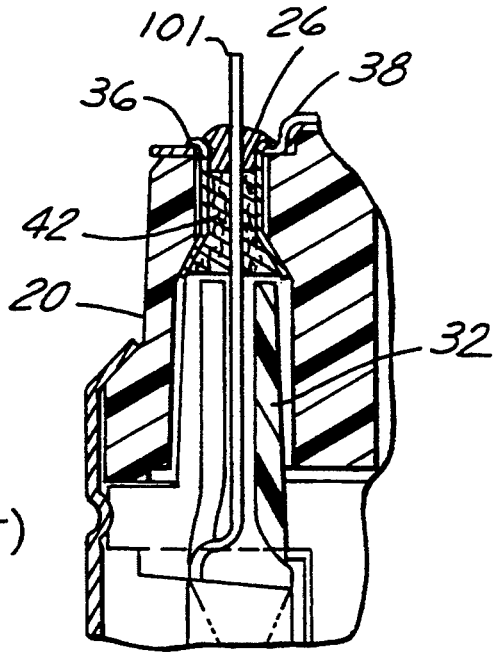
(PRIOR ART) FIG. 1C
FIG. 1C is a cross-sectioned view of the bobbin tower and tubular spacers utilized in the prior art.
Figure 2:
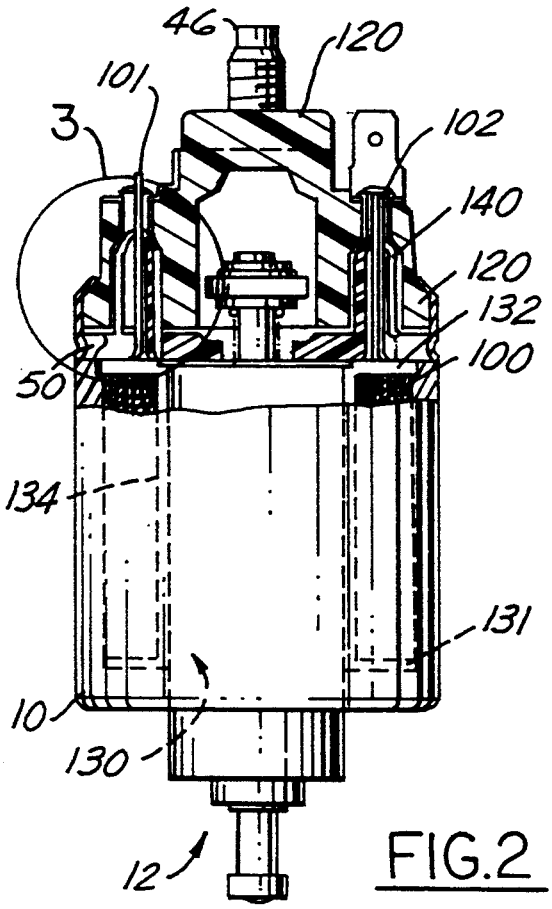
FIG. 2 is a partially cross-sectioned frontal elevation of a first preferred embodiment of the present invention.

Referring now to FIGS. 1A, 1B, and 1C, a prior art cranking motor solenoid is shown as including a generally cylindrical, hollow base housing section 10 for containing the bobbin and coil assemblies (not shown), which carry therein a plunger to which is attached a contact carrier 12 and a contactor plate 13. A first end 101 of the coil wire is illustrated as extending out of the top of a coil bobbin tower 32, which in turn extends above the disk shaped plunger stop plate 14.

A tubular shaped deformable spacer or sealer element 42 having an axial bore therein is fitted over the first end 101 of the coil wire for resting near the top end of the bobbin tower 32.

A metal eyelet 36 is coupled through an aperture in a housing cap 20 that is coupled within and is crimped against the circumference of the housing base 10. The first end 101 of the coil wire communicates upwardly through the eyelet 36 and exits the cap 20 in an area generally adjacent the connector 38 which is permanently affixed by the eyelet 36 to the cap 20. Connector 38 is coupled to a master screw-type connector 48 to provide a path to electrical ground for the pull-in winding (via the cranking motor). In a similar manner another eyelet 22 is soldered to a second end section 102 of the coil wire which is sealed therein by a second tubular spacer 40.

The tubular spacer 42 sometimes may be compressed along its longitudinal axis between the top of the adjacent bobbin tower 32 and the inside of the eyelet 36. Since the tubular spacer 42 is shorter than the effective length of the eyelet 36, a small cavity is defined at the upper end of the eyelet 36, which is normally filled with solder 26 as shown in FIG. 1C. The solder flow is allowed to cover the entire upper surface of the eyelet 36 in the process of electrically connecting the end section 101 of the coil wire to the conductor 38.

The lower surface of the void containing the solder is formed by the upper edge of the tubular spacer 42. However, in high volume manufacturing the mating between the tubular spacer 42 and the eyelet 36 is in practice not always controllable and uniform. In some instances the tubular spacer 42 falls out of the eyelet 36 before the solder 26 can be inserted therein, in which case the solder flows down the end section 101 of the wire and into the cavity defined within the housing 10.

This often results in a short circuit occurring between adjacent sections of the coil wire or between the coil wire and the housing 10. Also, the tubular spacer 42 cannot always be correctly spaced within the eyelet 36 so as to provide a void into which a constant and known volume of solder 26 can be automatically injected during a high speed manufacturing process. If the void is too large, then the solder does not always seal the opening of the eyelet. If the void is too small, then the solder overflows the top of the eyelet 36, which can also result in an unwanted short circuit.

DETAILED DESCRIPTION OF THE PREFERRED EMBODIMENT

The first preferred embodiment of the present invention is shown generally in FIGS. 2 through 6. With specific reference to FIG. 2, the generally cylindrical housing 10 defines therein a void for receiving the plunger assembly 12 and a bobbin 130. The bobbin 130 includes a first end or flange section 131 that couples with the inside surface of the lower section of the housing 10, and a second or upper end 132 to which a pair of distended bobbin towers 140 are integrally molded. A cork or insulating washer 58 also rides on the upper surface of the plunger stop plate 50. A generally cylindrical core section 134 communicates between the flanges on the first end 131 and the second end 132 of the bobbin for receiving the wire 100 coiled there around.

For purposes of clarity, only one coil winding is shown in detail. However, those familiar with automotive cranking motor solenoids will recognize that two coils are normally utilized. A first coil or pull-in winding is formed with heavier gage (typically 17 gage) wire for carrying the initial 30–35 amp current to pull-in the plunger assembly 12, thereby shorting the contactor plate 14 against threaded terminal connectors 46 and 48 for energizing the cranking motor. This process deactivates the pull-in winding while the smaller (typically 22 gage) hold-in winding remains energized while the cranking motor turns the engine. Both of these coils are wound around the cylindrical bobbin core 134 such that the ends of the coil wires, shown generally as 101 and 102, will terminate adjacent the upper bobbin flange 132. For sake of example, only a singular end 101 of the coil wire 100 will be discussed hereinafter, although two or more coil wires may be effectively substituted in the description of the present invention.

Figure 3:
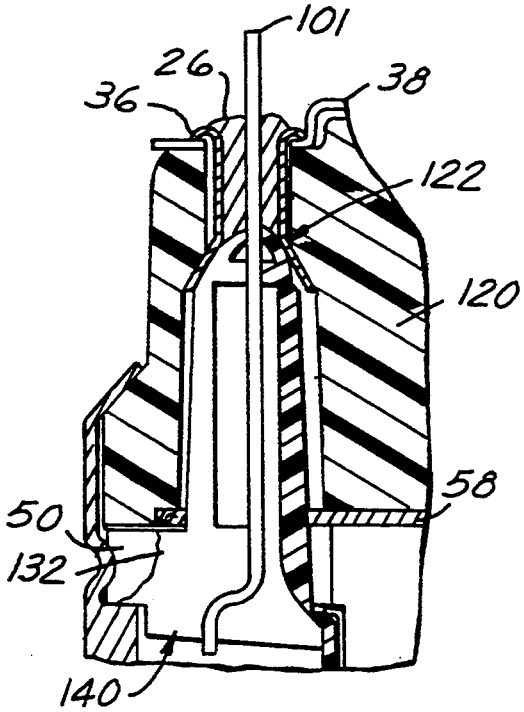
FIG. 3 is an enlarged cross-sectioned front elevation of the coil bobbin tower and housing cap sealing apparatus of the present invention.
Figure 4:
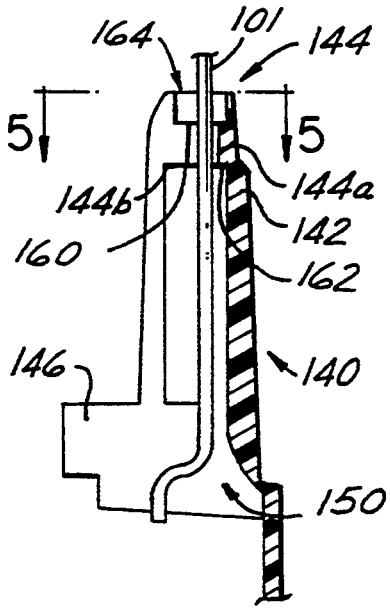
FIG. 4 is a cross-sectioned front elevation of the coil bobbin tower before it is compressed by the housing cap.

With reference to FIGS. 3 and 4, two identical bobbin towers 140 are attached on the top surface of bobbin flange 132. Each bobbin tower 140 has a tapered cylindrical shape, with the top end being slightly smaller in diameter than the bottom end. The two bobbin towers 140 are spaced apart on opposite sides of a central axis of the bobbin 130. The bobbin 130 and bobbin towers 140 are manufactured from an electrically insulating material such as glass filled nylon.

A cap 120 having a cylindrically shaped lower surface is sized to snugly fit within the upper open end of the housing 10. The upper rim of the housing is crimped as illustrated in FIG. 3 to engage a rim section adjacent the bottom of the cap 120, thereby forming a sealed housing. The first preferred embodiment of the cap illustrated in FIGS. 2 and 3 will be assumed to be generally the same as the cap illustrated in FIG. 1 as reference numeral 20. The cap is manufactured of a thermosetting, polyester material that acts as an electrical insulator.

With reference now to FIG. 4, the bobbin tower 140 includes an upper or distended end 142 defining a crown section 144 thereon. The crown section 144 has a slightly reduced thickness when compared to the base of the bobbin tower 140. A generally cylindrical void 150 is defined within the bobbin tower 140 for receiving the end section 101 of the coil wire 100 there through. As shown more clearly in FIG. 5, the wire 101 is smaller than the opening created by the crown 144 in the bobbin tower 140. However, when two or more wires are exiting through the crown section 144, and after the wires are prepared with a thin layer of solder, the effective diameter of the two wires will be substantially greater than illustrated in FIG. 5.

Figure 5:
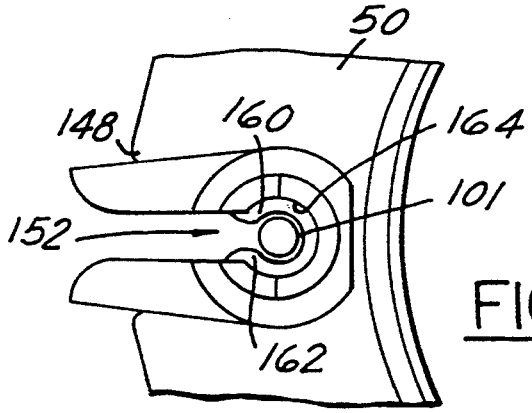
FIG. 5 is a top view of the coil bobbin tower before it is compressed by the housing cap.

Also illustrated in FIG. 5 is a slot 152 which communicates along the entire longitudinal direction of bobbin tower 140. The slot 152 is designed to allow the use of an automated process for winding the coil 100 around the bobbin core 134 and then sliding the section of the wire 101 into the slot 152 within the bobbin tower 140. The ends of the wire 101 are then stripped of insulation in preparation for soldering.

Figure 6:
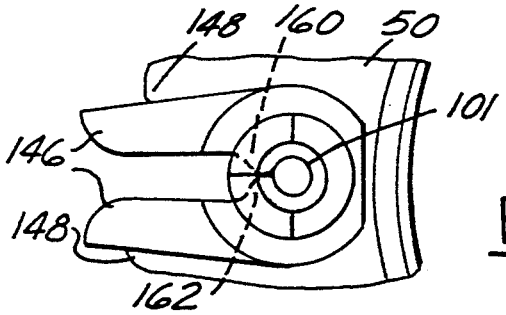
FIG. 6 is a top view of the coil bobbin tower after being compressed, with the housing cap removed for the sake of clarity.

The lower section of bobbin tower 140 includes a pair of flange extensions, illustrated generally as 146 in FIGS. 5 and 6, which are used to guide the end wire sections into slots in the bobbin towers 140 during the automated winding manufacturing process. Small crush rib tabs 148 are located on the outside surface of the extensions 146 for being deformed by engagement with the plunger stop plate 50, thus providing an interference fit between the bobbin and the plunger stop plate.

With reference to FIGS. 4 and 5, the sections of the crown 144 of the bobbin tower 140 which are adjacent to the slot 152 are of greater thickness than the sections opposite the slot 152. This difference in thickness and additional mass are required on the slot side 152 to assure the complete closure of the slot 152 and to prevent undue softening and melt down of the crown section 144 when solder flows into the void adjacent the wire 101. As illustrated in FIG. 6, the crown section 144 is shaped and dimensioned so as to couple tightly with the end section 101 of the coil wire, thereby forming a seal for restricting the flow of solder 26 therethrough.

With reference to FIG. 3, the cap 120 includes an eyelet 36 having a generally cylindrical form which is upset or clinched adjacent the top end thereof so as to engage the connector 38. The eyelet 36 communicates downwardly into the cap through a cylindrical bore that tapers outwardly at generally a 30 degree angle at section 122 to a larger cylindrical bore for receiving the bobbin tower 140 therein. In a similar manner the lower-section of the eyelet 36 is flared to generally conform to the section 122 of the cap 120 for mating with the crown section 144 of the bobbin tower 140.

As illustrated in FIGS. 4 and 5, the slot 152 is open when the bobbin tower 140 is not inserted within the cap 120. However, as illustrated in FIG. 3, when the cap 120 is mated with the housing 10, the tapered section 122 of the cap and the tapered section of the eyelet 36 force the upper rim of the crown 144A and 144B to compress and deform inwardly to seal against the end section 101 of the coil wire. This compression and deformation, which is shown more clearly in FIG. 6, causes the slot 152 in the crown section 144 to close, thereby forming a generally conical or domed section having the coil wire end 101 exiting the top thereof. The diameter of the crown section 144, and the thicknesses of the upper sections 144A and B, together with the length of bobbin tower 140, are determined such that the outside surfaces of the crown 144 will compress and seal against the inside tapered surface of the eyelet 36.

Therefore, as illustrated in FIGS. 3 and 6, the crown section 144 of the bobbin tower 140 completely seals against both the tapered section of the eyelet 36 and the end section 101 of the wire. This seal forms the lower surface of a void of known volume within the eyelet 36. This void is then filled with molten solder 26 for connecting, both electrically and mechanically, the end section of the wire 101 with the eyelet 36, the connector 38, and also thereby mechanically connecting the cap 120 to the housing 10, as well as the bobbin 130 compressed therewithin. As was discussed above, the additional thickness of the section 144B of the crown 144 is required to seal the upper section of slot 152 and to effect a thermal barrier that will not soften or melt as the molten solder is deposited within the eyelet 36 and thereafter is allowed to cool and solidify.

This construction of the crown section 144 of the bobbin tower 140 will prevent the molten solder from "wicking down" the end section 101 of the wire to short with adjacent sections of the coil wire or sections of housing. These couplings will form a well defined, constant and repeatable volume within the eyelet 36 so that a known volume of solder can be dispensed without spilling over.

A shallow cylindrical cavity 164 having a diameter slightly larger than the end of the wire 101 is defined within the distended end of the crown 144 on the bobbin tower 140, as illustrated in FIG. 4. The thin sides or lips defining the cavity 164 may be deformed radially inward to form an upper seal against the wire 101 as the crown 144 is compressed against the tapered inside surface of the eyelet 36, as illustrated in FIGS. 3 and 6.

The cranking motor solenoid in accordance with the first preferred embodiment of the present invention is assembled as follows. After the wire 100 is wound around the bobbin 130, the ends 101 and 102 are pulled through the slots 152 so as to extend out of the top or crown sections 144 of the respective bobbin towers 140. The bobbin assembly 130 is then inserted into the housing 10. The plunger assembly, to which was previously attached the contactor plate 14 and the contact carrier, is then inserted into the central void defined by the bobbin core 134. The plunger stop plate 50 is then coupled to the top of the bobbin flange 132 such that the keyway openings therein will engage the flanges 146 and compression tabs or crush ribs 148. A cork or insulating washer 58 is then placed on top of the plunger stop plate 50.

Terminal 28 and connector 38, as well as threaded terminal connectors 46 and 48, are then attached to the upper surfaces of the cap 120. The eyelet 36 is coupled through the end of the connector 38 so as to communicate downwardly through the bore in the cap 120 ending adjacent the tapered section 122 therein. The upper end of eyelet 36 is upset or clinched to fix the spade terminal 28 to the cap 120. While a spade terminal is illustrated, a threaded stud terminal could also be used.

The cap 120 is then coupled over the bobbin towers 140 such that the lower edge of the cap 120 compresses the washer and rests on the plunger stop plate 50. In this manner the crown section 144 of the bobbin tower 140 is deformed to seal against the lower section of the eyelet 36 and around the end section 101 of the wire.

While the first preferred embodiment of the present invention has been illustrated as the best mode of the invention, one skilled in the art will be able to make minor changes in this design without departing from the scope of the intended invention and the accompanying claims. It is intended that all descriptions of the preferred embodiment, including the drawings, should be interpreted as illustrative and not as limitations on the scope of the invention.

I claim:

1. An apparatus for sealing with a section of wire communicating through an aperture in a first section of a housing of an automotive electrical component having a cavity therein, comprising:

sealing means having a distended section for coupling into the aperture and sealing with the first section of the housing adjacent the aperture, said distended section also having therein a longitudinal slot for receiving therein, deforming around and sealing with the section of wire responsive to said sealing means being compressed in the longitudinal direction into the aperture within the first section of the housing, and pressure means, carried within the cavity, for compressing said sealing means in said longitudinal direction between the first section of the housing having the aperture therein and a second section of the housing spaced from the first section, whereby the compression causes said sealing means to seal with both the section of wire and the first section of the housing as the section of wire communicates therethrough.

2. The sealing apparatus as described in claim 1 wherein said pressure means includes spacer means, carried within the cavity, for being compressed between the first and second sections of the housing.

3. The sealing apparatus as described in claim 2 wherein the housing includes a base section for defining the second section and a cap section for defining the first section, whereby the compression exerted by said pressure means is formed by the coupling of said cap with said base of the housing.

4. The sealing apparatus as described in claim 3 wherein said spacer means includes bobbin means for carrying the coil of wire within the cavity.

5. The sealing apparatus as described in claim 1 wherein said pressure means includes tapered receiving means coupled to said first section of the housing adjacent the aperture therein for cooperating with said distended section of said sealing means for converting at least a portion of the compression in said longitudinal direction into radial compression around the circumference of the section of wire to be sealed.

6. The sealing apparatus as described in claim 5 wherein said distended section of said sealing means further includes circumferential lip means for deforming radially toward and sealing with the section of wire as said distended section is compressed in said longitudinal direction within said tapered receiving means.

7. A bobbin assembly for sealing with the end section of a coil of wire as it exits the housing of an automotive electrical component, comprising:

bobbin means for receiving and carrying the coil of wire, a cap for coupling with the housing having the coiled wire therein, said cap including an aperture therein adapted to receive the end section of the wire therethrough, and tower means, coupled to and distending from said bobbin means, for defining therein a longitudinal slot for receiving, coupling and sealing with the end section of the wire, and for coupling with and sealing against said cap adjacent said aperture therein responsive to compression in the longitudinal direction exerted by said cap coupling to the housing.

8. The protective assembly described in claim 7 wherein said bobbin means is compressed between the housing and said cap for compressing said tower means into said aperture in said cap.

9. A method for forming a seal between a housing of an automotive electrical component and a section of wire passing through an aperture in the housing, including the steps of:

coupling a barrier only partially around the circumference of the section of wire, deforming said barrier radially about a longitudinal axis of the wire in response to compression along said longitudinal axis so as to form an effective seal around the entire circumference thereof, and compressing said barrier along said longitudinal axis of the wire and into the aperture of the housing so as to form an effective seal therebetween.

10. The method for forming a seal as described in claim 9 wherein said barrier comprises a tube having a slot for receiving the wire therein, and wherein the deforming step includes the step of:

closing said tube with the section of wire within said slot so as to seal around the entire circumference of the wire.

11. The method for forming a seal as described in claim 10 wherein the compressing step includes the step of:

inserting an end of the tube with the section of wire therein into the aperture in the housing such that the compression causes the tube to radially expand to seal with the housing adjacent the aperture.

* * * * *